252-149 AU 165 EX
3/29/77 XR 4,014,715

United States Patent [19]

Preston

[11] 4,014,715

[45] Mar. 29, 1977

[54] SOLDER CLEANING AND COATING COMPOSITION

[75] Inventor: John M. Preston, Lynchburg, Va.

[73] Assignee: General Electric Company, Lynchburg, Va.

[22] Filed: Dec. 8, 1975

[21] Appl. No.: 638,829

[52] U.S. Cl. ..... 148/6.17; 134/3; 134/41; 252/136; 252/142; 252/149

[51] Int. Cl.[2] ..... C23F 7/12; C23F 7/08; C11D 7/08

[58] Field of Search ..... 148/6.17, 6.15 R; 252/136, 142, 149; 134/3, 41

[56] References Cited

UNITED STATES PATENTS

| | | | |
|---|---|---|---|
| 2,318,559 | 5/1943 | Percival | 134/3 X |
| 3,181,984 | 5/1965 | Tillis | 134/41 X |
| 3,249,547 | 5/1966 | Fisher | 252/136 |
| 3,296,149 | 1/1967 | Cook et al. | 252/136 X |
| 3,689,292 | 9/1972 | Preston | 106/1 |

*Primary Examiner*—Harris A. Pitlick
*Attorney, Agent, or Firm*—James J. Williams

[57] ABSTRACT

Relates to a composition and method for cleaning and coating metal surfaces comprising a mineral acid, a phosphoric acid concentrate having a $P_2O_5$ content of ~~about 72-80%~~ formed by heating 54% phosphoric acid with a mono- or polysaccharide, a dibasic acid such as succinic acid, thiourea and a wetting agent.

4 Claims, No Drawings

SOLDER CLEANING AND COATING COMPOSITION

BACKGROUND OF THE INVENTION

This invention relates to a composition and metal of treating solder plated printed circuits and other metal surfaces to remove oxidation and foreign contaminants. The invention further includes the deposition of a non-oxidizable film on the cleaned surface.

The removal of solder, oxides and other contaminants from a plated surface is known. The cleaning agent usually comprises a strong mineral acid. These acids may include hydrochloric, sulfuric and fluoboric acid. In addition phosphoric acid may be used with a carbohydrate.

Referring to the prior art, Beach U.S. Pat. No. 3,450,577 relates to a cleaner-coater composition for treating metal surfaces which contains an alkali metal phosphate and sugar. The sugar disclosed may be disaccharide such as sucrose, maltose and others.

Cook et al Pat. No. 3,296,149 discloses a corrosion inhibiting composition comprising a mixture of molasses, potassium iodide and a metal salt of a fatty acid. Phosphoric acid may be included in the composition.

The Fisher U.S. Pat. No. 3,249,547 also discloses a corrosion inhibiting orthophosphoric acid composition containing molasses. Still another patent containing orthophosphoric acid and molasses is U.S. Pat. No. 1,935,911 — Neilson.

The use of phosphoric acid having a high $P_2O_5$ content is known in electroless plating composition as shown by Applicant's U.S. Pat. No. 3,689,292. The patent is directed to the provision of a lustrous adherent tin plate on a base metal.

In his patent invention the Applicant adds additional succinic or other dibasic acid to his cleaning composition. The original super phosphoric acid may contain about 0.2 grams of succinic acid. The addition dibasic acid adds longer life to the bath and results in a better cleaning action due to the tie up of undesirable ions such as copper.

SUMMARY OF THE INVENTION

It is therefore an object of my invention to provide a cleaner for the removal of oxidation and foreign contaminants from plated metal such as solder plated printed circuits.

It is a further object of my invention to deposit a non-oxidizable film on the metal surface.

Another object is to add a dibasic acid to the composition.

A further object is to allow reflowing the solder plating without a change in composition.

Briefly stated, this invention relates to a composition containing a mineral acid, water, thiourea, a wetting agent, super phosphoric acid concentrate having a $P_2O_5$ content of 72–80% and a dibasic acid such as succinic and others having the general formula $C_nH_{2n}—_2O_4$. As stated this composition is especially suited to solder cleaning, e.g. the removal of oxidation and foreign contaminants from solder plated printed circuits and also for the deposition of a non-oxidizable film on the cleaned solder.

DETAILED DESCRIPTION

The mineral acids used comprise sulfuric, fluoboric and hydrochloric. In a gallon of the composition the quantity of the acid used may vary as follows:

| | |
|---|---|
| Sulfuric | 200 ml. to 500 ml. |
| Fluoboric | 200 ml. to 400 ml. |
| Hydrochloric | 200 ml. to 375 ml. |

The quantity of the super phosphoric acid concentrate added to the cleaning composition may vary from 38 ml. to 567 ml. Thiourea or its derivatives may vary from 55 grams to 76 grams, and the wetting agent from 3.8 ml. to 7.5 ml.

The additional succinic acid (0.1 to 1.0 grams) may be added to the original super phosphoric solution or may be added separately to the composition batch.

The super phosphoric acid is prepared by heating a phosphoric acid containing 54.5% $P_2O_5$ with 2–5% of a monosaccharide or polysaccharide such as sucrose, maltose, glucose, fructose, lactose and mannose at a temperature of 300° F to concentrate the mixture to 72–80% $P_2O_5$. This concentrate contains about 0.2 g. of succinic acid and small amounts of organic phosphates and succinates. Any phosphoric acid may be used that has a $P_2O_5$ content between 72–80%.

Applicant prefers to use distilled water or deionized water in the composition so as not to alter the phosphorus content.

The wetting agent or surfactant may comprise Triton X 100 by Rohm and Haas, which is the octyl phenyl ether of a polyethylene glycol containing 9–10 ethoxy groups per moleculte. Alkyl phenyl alkoxy or other types of surfactants may be used.

The following examples are illustrative of the invention

EXAMPLE I

The following ingredients were used to make up one gallon of the cleaning composition:

| | Min. | Max. |
|---|---|---|
| Sulfuric acid | 200 ml. | 500 ml. or |
| Fluoboric acid | 200 ml. | 400 ml. or |
| Hydrochloric acid | 200 ml. | 375 ml. |
| Superphosphoric acid | 38 ml. | 567 ml. |
| Succinic acid | 0.1 g. | 1.0 g. |
| Thiourea | 55 g. | 76 g. |
| Wetting agent or surfactant | 3.8 ml. | 7.5 ml. |
| Water | | remainder |

EXAMPLE II

The following ingredients were used to make up one gallon of the cleaning composition:

| | |
|---|---|
| Sulfuric, fluoboric or hydrochloric acid | 200 ml. |
| Super phosphoric acid | 400 ml. |
| Water | 3000 ml. |
| Thiourea | 55 grams |
| Succinic acid | 0.5 grams |

All of the above ingredients were mixed while agitating and applied to the surface to be cleaned. Excellent results were obtained in the cleaning of solder plate. It was found that the cleaning of solder plated printed circuits after etching makes possible reflowing the solder plating without a change in composition due to oxidation of the solder after etching, or from residues left on the solder from the copper etch. If cleaning is not done prior to reflowing, the solder may not melt or if fused a frosted coating may appear on the solder due to impurities. This composition inhibits the redeposition of metals on solder plate. this redeposition is further prevented in a heated solution by depositing or reacting with the cleaned solder forming a phosphate coating on the solder surface. The phosphate coating consists of complex polyphosphates. The exact composition has not been determined because of the micro amounts present.

Those parts of the present invention which are considered to be new are set forth in detail in the claims appended hereto. The invention, however, may be better understood and further objects and advantages appreciated by reference to the above detailed description.

What I claim as new and desire to secure by Letters Patent of the United States is:

1. A cleaning and coating composition comprising 200–500 ml. of an acid selected from the group consisting of sulfuric, hydrochloric and fluoboric, 38–567 ml. of a phosphoric acid concentrate having a $P_2O_5$ content of 72–80%, 55–76 grams of thiourea, 0.1–1.0 grams of a dicarboxylic acid and 3.8–7.5 ml of a wetting agent, together with enough water to make one gallon of the composition.

2. The composition of claim 1 wherein the sulfuric acid is present in amounts ranging from 200–500 ml., hydrochloric in amounts ranging from 200–375 ml. and fluoboric in amounts ranging from 200–400 ml.

3. A cleaning and coating composition comprising: 200 ml. of an acid selected from the group consisting of hydrochloric, sulfuric or fluoboric, 3000 ml. of deionized water, 55 grams of thiourea, 400 ml. of a phosphoric acid concentrate having a $P_2O_5$ of 72–80%, and 0.1–1.0 grams of succinic acid.

4. A process of removing oxidation and foreign contaminants from a solder plated printed circuit and the deposition of a phosphate film on the solder surface which comprises:

a. preparing a cleaning and coating bath from a solution containing an acid selected from the group consisting of 200–500 ml. of sulfuric acid, 200–400 ml. of fluoboric acid and 200–375 ml. of hydrochloric acid, 38–567 ml. of a phosphoric acid concentrate prepared by reacting 2–5% of a monosaccharide or polysaccharide and 54% of phosphoric acid heated at 300° F to concentrate the mixture to 72–80% of $P_2O_5$, 0.1–1.0 grams of a dicarboxylic acid, 3.8–7.5 ml. of a wetting agent, 55–76% of thiourea and sufficient water to make one gallon of the composition;

b. agitating the composition at room temperature;

c. and applying the composition to a solder surface to remove the contaminants and produce a phosphate coating on the solder surface.

* * * * *

UNITED STATES PATENT OFFICE

CERTIFICATE OF CORRECTION

Patent No. 4,014,715 Dated March 29, 1977

Inventor(s) John M. Preston

It is certified that error appears in the above-identified patent and that said Letters Patent are hereby corrected as shown below:

Column 1, line 6, cancel "metal" and insert -- method --

Column 1, line 41, cancel "addition" and insert -- additional

Column 3, line 11, cancel "this" and insert -- This --

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*